United States Patent [19]

Otte et al.

[11] 4,047,306

[45] Sept. 13, 1977

[54] BORE HOLE PROBE

[76] Inventors: Hubert Josef Otte, 165 Evelyn Avenue; Gosta Roosman, 98 Merrick Street, both of Toronto, Canada

[21] Appl. No.: 693,110

[22] Filed: June 4, 1976

[51] Int. Cl.[2] ..... E21B 47/022

[52] U.S. Cl. ..... 33/314

[58] Field of Search ..... 33/314, 304, 308, 309, 33/313; 346/107 W

[56] References Cited

U.S. PATENT DOCUMENTS

| | | | |
|---|---|---|---|
| 1,187,519 | 6/1916 | Galvin | 33/314 |
| 2,792,637 | 5/1957 | Seigel et al. | 33/314 |

FOREIGN PATENT DOCUMENTS

| | | | |
|---|---|---|---|
| 825,374 | 10/1969 | Canada | 33/314 |

*Primary Examiner*—Harry N. Haroian
*Attorney, Agent, or Firm*—George A. Rolston

[57] ABSTRACT

A bore hole probe instrument having a point source of light, passing through a flexible tubular portion. The point of light, which originates at one end of the flexible tubular portion, is established for example by means of fibre optics, a laser or the like. At the other end of the flexible tubular portion there is located an automatic camera having an image screen, on which the point of light is received. As the flexible tubular portion bends, to follow the path of the bore hole, the light spot will be deflected on the image screen. The camera will photograph the position of the light spot on the image screen thereby providing an indication of the deviation of the bore hole.

12 Claims, 5 Drawing Figures

BORE HOLE PROBE

The invention relates to a bore hole probe such as is used for passing down a bore hole in a geological strata, to determine the deviation of the bore hole from its intended path.

BACKGROUND OF THE INVENTION

When drilling bore holes through geological strata, in mining or exploration work, it is almost impossible to ensure that the bore hole is drilled out in the exact path intended.

The data obtained from such bore holes must therefore be interpreted in the light of possible variations in its paths from the intended path. Thus the information which can be gathered from for example a combination of several separate bore holes through a particular geological body or structure may be subject to wide differences in interpretation, depending upon the degree of wander of the various bore hole paths.

Many devices have been proposed to be passed down such bore holes, in an attempt to log deviations of the path. Such devices have included simple pendulum devices, and simple magnetic devices, and have included highly complex gyroscopic devices, and optical and photographic devices have also been proposed.

However, the conditions under which such devices are used make it absolutely essential that they shall be as far as possible totally independent of climatic conditions, magnetic variations in the strata, or any other conditions which might otherwise interfere with the operation of or accuracy of the instrument. In addition, many prior proposals for this type of instrument have involved the use of electrical cables being threaded down the bore hole. In many cases this is impractical. The instrument will not always fall readily down the hole, especially if it wanders substantially from the vertical. It must therefore be attached to a series of drill rods and progressively fed down the hole. This has made it extremely difficult to provide any control over the instrument, from the surface.

Accordingly, it is desirable to provide an instrument of this type which is totally automatically operated independently of the surface.

BRIEF SUMMARY OF THE INVENTION

The invention therefore seeks to provide a bore hole probe instrument having a point source of light, passing through a flexible tubular portion. The point of light, which originates at one end of the flexible tubular portion, is established for example by means of fibre optics, a laser or the like. At the other end of the flexible tubular portion there is located an automatic camera having an image screen, on which the point of light is received. As the flexible tubular portion bends, to follow the path of the bore hole, the light spot will be deflected on the image screen. The camera will photograph the position of the light spot on the image screen thereby providing an indication of the deviation of the bore hole.

Preferably, in accordance with the invention, the image screen will also incorporate some form of indicator showing either the top or bottom of the screen. Such an indicator will usually be some form of gravity operated device, giving a visual indication which is incorporated in the photograph taken by the camera.

In accordance with one feature of the invention, the point source of light is established simply by fibre optic means such as a single fibre optic thread passing through the flexible tubular portion. Preferably, the fibre optic thread will rigidly supported by any suitable support sleeve so that it effectively acts as a light beam and establishes a point source of light on the image screen. It will of course be appreciated that any other means for establishing a point source of light on the screen, which is also sensitive to flexing of the flexible tubular portion, will be equally effective.

In one specific form of the invention, the vertical indicator will be in the form of an air bubble in a tube the remainder of which is filled with a liquid such as oil.

Preferably, in accordance with the invention, the instrument will be provided with drill rod coupling means at both ends, so that drill rods may be attached both above and below the instrument. In this way, the instrument may be attached to the end of a length of drill rod, and a further length of drill rod may be attached in front of the instrument thereby protecting the instrument as it is passed down the bore hole. In addition, the instrument will thus be located in a length of drill rod sections, which will thus bend and conform more accurately to the overall path of the bore hole.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there is illustrated and described a preferred embodiment of the invention.

DESCRIPTION OF A SPECIFIC EMBODIMENT

Figure 1:
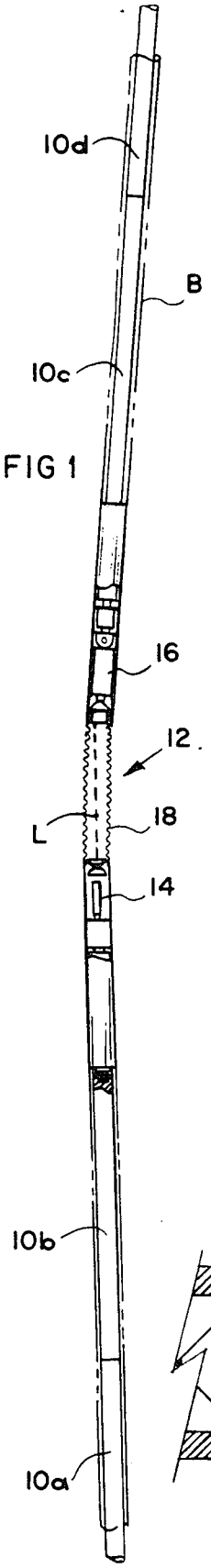
FIG. 1 is a schematic elevational view, showing the instrument located in a bore hole, shown in phantom, with a portion thereof cut away.

Referreing initially to FIG. 1, the invention is shown schematically being illustrated in location in a bore hold marked B, being used in conjunction with length of drill rod marked 10*a* 10*b* 10*c* and 10*c* and so on.

The instrument according to the invention is shown by the general reference arrow 12 and comprises three main portions namely a light beam unit 14, a camera unit 16, and a flexible junction portion 18 extending between the light beam portion 14 and the camera portion 16.

Figure 3:
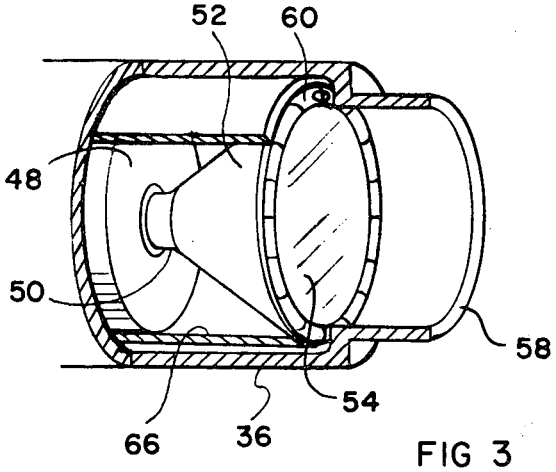
FIG. 3 is a cut away perspective illustration of the image screen and the fibre optics.
Figure 2:
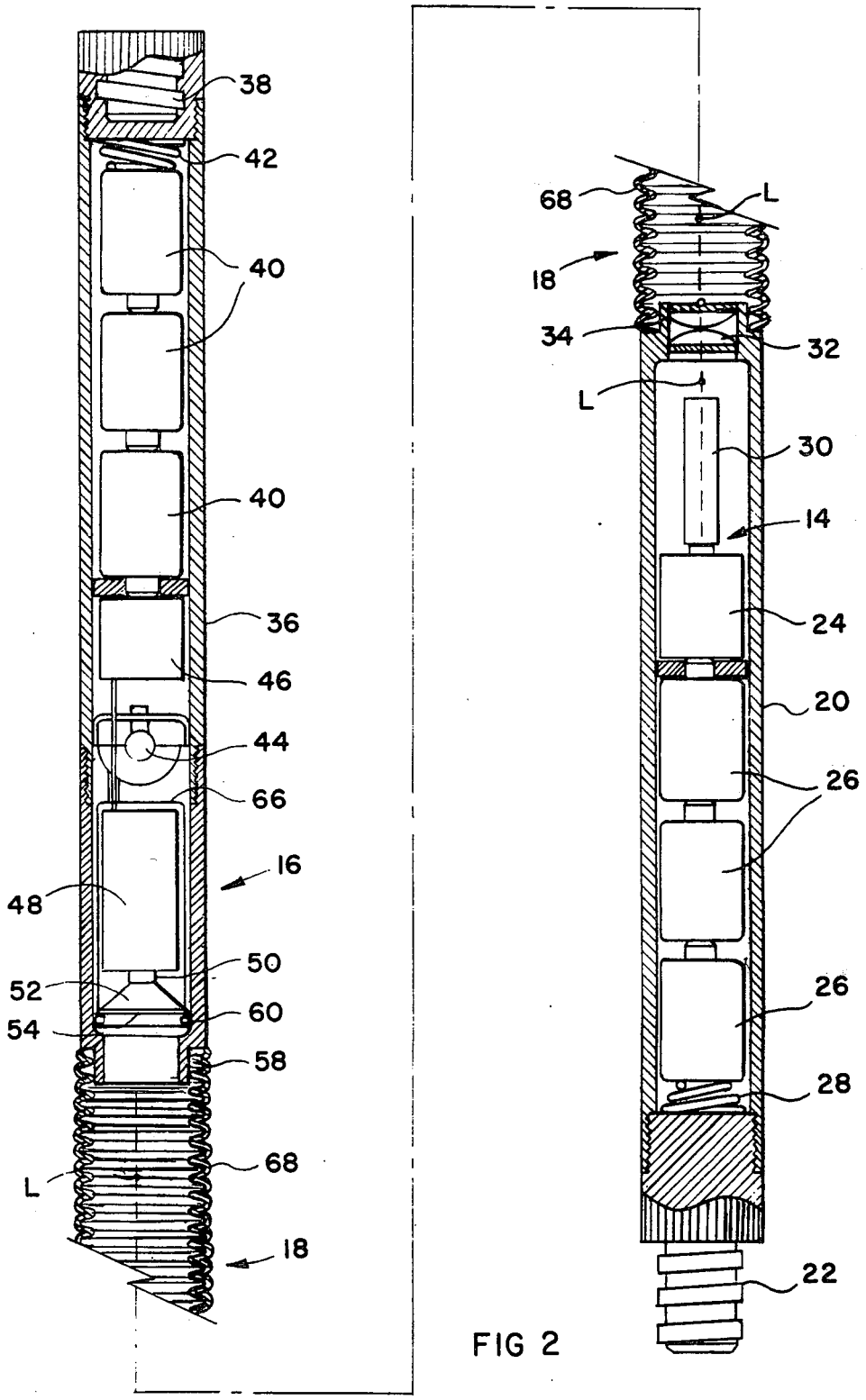
FIG. 2 is a greatly enlarged longitudinal section of the instrument shown in FIG. 1, with a portion of the flexible tubular section cut away for the sake of clarity.

The details of the invention will now be described in conjunction with FIGS. 2 and 3.

Dealing first with the light beam generating portion 14 it will be seen to comprise a tubular cylindrical housing 20, having at its lower end a drill rod coupling means such as threaded connection 22. It will of course be appreciated that any other drill rod coupling means could be provided. Alternatively, if it is desired not to use the unit with drill rods, some other form of extension of the housing 20 could be provided, or the housing 20 could simply be made much longer. The only objective in the extension of the length of the housing is to achieve overall conformity of the entire instrument with the path of the bore hole.

Within the housing 20 there is provided a light source 24 which may for example be a laser beam generator, or may alternatively be simply a high intensity flash light bulb. A series of batteries 26 is provided, and a spring 28 may be provided for the purpose of ensuring contact between the batteries 26, and the light generating means 24.

There may also be provided a light conducting rod 30 any suitable plastic such as "Lucite" (trade mark) and a light concentrating lens or group of lenses 32 will be provided at the upper end of the housing 20 for concentrating the light into a high intensity small diameter beam of light indicated in phantom by the reference arrow L the light beam L is thus directed precisely along the central axis of the housing 20.

Around the exterior of the lenses 32, there may be provided a short collar 34.

The second portion of the instrument namely the camera portion 16 comprises a similar cylindrical tubular housing 36 having any suitable means such as the female thread 38 at its upper end form connection with drill rod, although obviously any other connection system would be suitable depending upon the type of drill rod used.

Alternatively, if some system other than drill rod is employed, then any other coupling system will be suitable.

Within the housing 36 there are provided batteries 40 held in position by means of spring 42 or any other suitable system. The batteries 40 power various functions namely they power a light source 44 and they operate timer 46. They may also operate the automatic camera 48. The camera 48 may in fact be similar to a small motion picture camera using for example 8 milimeter film with the exception that the timing between exposure of individual frames of the film will usually be dependant upon the timer 46. The motion picture camera may be operated for example by a clock motor or by an electric motor powered by the batteries 14, or by any other suitable battery system.

The lens 50 of the camera 48 is shrouded in a suitable hood 52 which supports and locates an image screen 54 within any suitable collar or support 58 at the open end of the housing 36.

In order to provide a reference point indicating the inclination of the entire instrument, ie. the angle by which it deviates from the vertical, there is provided an air bubble system comprising the annular ring-shaped tube 60 located around the image screen 54. The tube 60 is preferably transparent, being formed of any suitable transparent plastic and contains any suitable liquid, usually some form of oil 62 leaving a single air bubble 64 therein so that the air bubble operates in the same way as a spirit level and provides an indication of the inclination of the instrument.

In order to illuminate the ring 60, light from the light source 44 which is located behind the camera 48 is communicated around the camera 48 by means of the light transmitting plastic sleeve 66 which fits around the camera 48 and extends up beyond the hood 52. In this way, light may be communicated to illuminate the ring 60 without illuminating the entire image screen 54 and thereby spoiling the picture to be recorded.

Between the two cylindrical housings 20 and 36, a flexible bellows member 68 is provided, being connected between the collars 34 and 58 respectively. The bellows member 68 should be sufficiently flexible that it may follow to and conform to any significant deviations in the path of the bore hole. It will not however be such that it can expand or contract along the length of the instrument nor will it be excessively flexible so that it may bend or buckle too easily.

In operation, the timer 46 will be set to commence operation after a suitable time limit sufficient to introduce the device into the bore hole. The instrument is then attached in a length of drill rod with drill rods **10*a* and 10*b* extending below the instrument and drill rods 10*c*, 10*d*, etc., extending upwardly above the instrument and it is then introduced into the bore hole. Movement of the device down the bore hole will be stopped just prior to the time when the timer will initiate the first picture. During this time the light source 24 is emitting a light beam L which is passing along the flexible portion 18 and striking the screen 54. Any deflection of the cylindrical housing 20 relative to the cylindrical housing 36 will bend the flexible portion 18 thereby deflecting the light beam L. Such deflection may take place more or less continuously while the device is being lowered. It is thus necessary that it be held stationary while the timer initiates the operation of the camera 48**.

When the device is stationary, the light beam L will establish a sharp distinct spot of light on the image screen 54. At the same time, the light source 44 will be operated so as to illuminate the tubular ring 60. The camera 48 will then operate so as to expose one frame of film. The picture thus taken will essentially consist of a ring of light, created by the illumination of the tubular ring 60 with a picture of the air bubble in the tube 60 at whatever point it has settled down. There will also be a single spot of light somewhere on the image screen. It will of course be in the center of the image screen and thus in the center of the frame of film if the entire instrument is in perfect alignment. Otherwise, it will show a deflection from the center equal to the angular displacement between the upper and lower portion of the instrument, and corresponding to the degree of bend in the flexible portion 18. As soon as the timer at the surface indicates that the picture has been exposed, then more drill rods will be attached and the device will be lowered until the timer indicates that the next picture frame is due to be exposed at which time movement will again be halted. During this time it will of course be possible to maintain a precise measurement of the position of the instrument down the bore hole simply by counting the number of drill rods attached during each period of movement.

Figure 4:
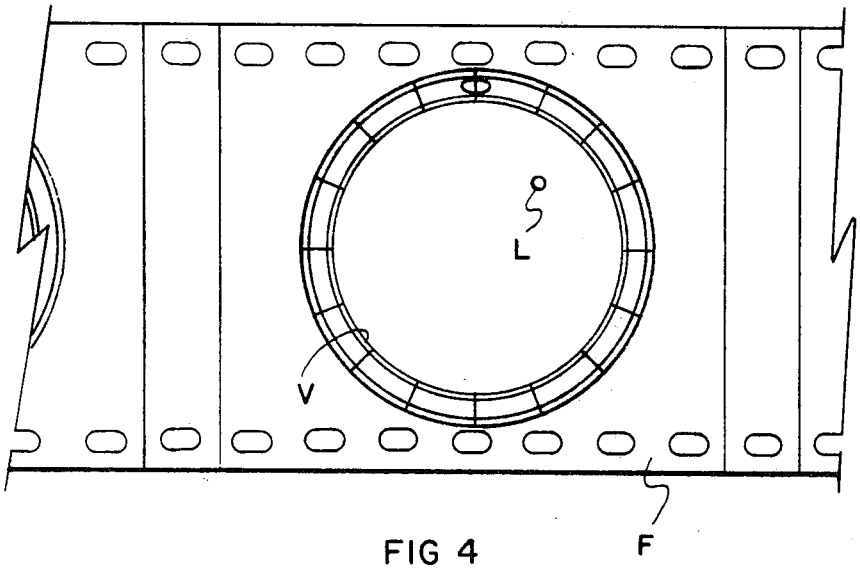
FIG. 4 is a schematic illustration showing a single frame of film from the camera having been exposed, and placed under a viewing device as a graticule, and, FIG. 5 is a schematic view of a further embodiment.

When the entire length of the hole has been traversed and the device has been withdrawn, the film is exposed. Each frame is then placed under a viewing device indicated as Z in FIG. 4 having for example a suitable graticule or other marking from which the deviation of the light beam L from the center can be readily plotted. The plot is then of course computed against the particular station at which the frame was exposed. In this way, a substantially precise accurate plot of the deviation of the bore hole can be compiled.

As will be apparent to those skilled in the art, the instrument has many advantages in that it is operated completely independently from conditions at the surface. All that is required is to have an accurate timer at the surface which is syncronized with the operation of the timer 46 in the instrument itself.

If this is found to create any practical difficulties then it is conceivable that the timer 46 could be removed and replaced by some other instrumentality for operation the camera 48 in response to a signal from the surface. Such a signal might conceivably be carried down the drill rod itself for example in the form of an electrical or magnetic pulse of some kind. Another possible solution is the use of a sound wave in a predetermined frequency band. Such a sound wave might be created for example by a tuning fork or the like applied to the drill rod. In practice however it is found that any such additional instruments only add to the degree of difficulty of operation of the device and create additional uncertainties, and it is preferable that the operation of the device should be entirely automatic and self sustaining as it is passed down the hole.

It will of cource be understood that there are a number of variations which may be used from time to time. For example, while the invention is shown illustrated as using two separate sets of batteries, one in the upper portion and one in the lower portion of the instrument, it is of course obvious that only a single set of batteries may be sufficient, and in this case suitable connections would have to be arranged to carry power from the batteries to the other section of the instrument.

It will also be understood that the use of the air bubble in the oil filled tube will generally speaking not be sufficiently sensitive to determine minor deviations from a vertical orientation. Clearly, the bubble will not function when the device is perfectly vertical, ie. 90°. Even at 89° the bubble is still somewhat uncertain. It becomes more reliable when the instrument is tilted passed 88° and 87°.

Accordingly, for a fully versatile instrument capable of reading at or close to the vertical, it will be desirable to incorporate some other form of more sensitive inclination instrument such as a pendulum, gyro, or the like. However, for the purposes of the present invention the details of such other instrumentalities are omitted for the sake of clarity.

Figure 5:
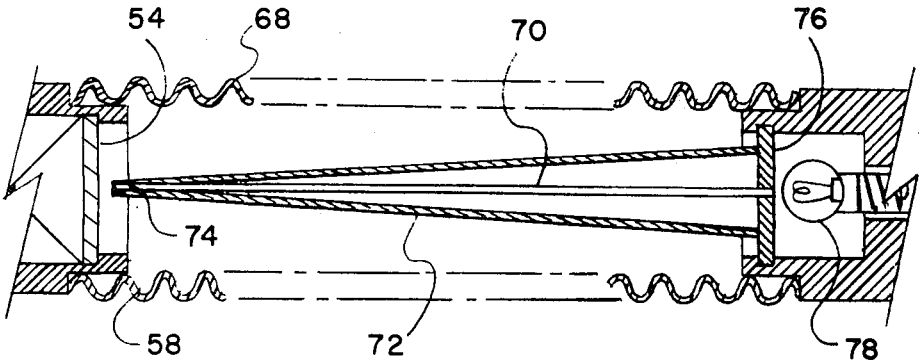

According to a further embodiment of the invention as shown in FIG. 5, the use of a laser beam may be dispensed with. In some cases, the power requirement for the generation of a satisfactory laser beam may be beyond the capabilities of the batteries in the instruments, or alternatively may require an excessive time delay between charging up of capacitors or similar storage circuits.

Accordingly, the laser beam may be replaced by a fibre optic thread 70. The fibre optic thread 70 will be typically of a flexible or semi-flexible plastic material of a type well known in the art. Accordingly, it will require support, and in this case this is provided by a metallic rigid sleeve 72. The sleeve 72 is of concical shape, having a relatively broad base and tapering essentially to a point as at 74. The sleeve 72 is preferably hollow in the interior, to save weight, although in fact all that is required is that there shall be a passageway therethrough sufficient to receive the fibre optic thread 70. The free end of the thread 70 is cemented or fastened in the tip 74 of the sleeve 72.

The base of the sleeve 72 is mounted on a mounting plate 76 which will typically be mounted on the collar 34 of the lower instrument body 20.

The plate 76 will have a hole passing therethrough through which the fibre optic thread 70 may pass. Typically, the end of the thread 70 will be cemented in such hole. Any suitable light source such as a light bulb 78, supplied by means of the batteries 26 will be sufficient to illuminate the fibre optic thread 70. The flexible bellows like portions 68 will fit around the exterior of the sleeve 72, and the sleeve 72 will thus be able to swing relative to the image plate 54 thereby locating the light beam stablished by the fibre optic thread 70 on any point on the surface of the plate 54.

The operation of the device will therefore be seen to be exactly the same as in the case of the laser unit.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A bore hole probe for determining the path of a bore hole and comprising a source of radiant energy support means for said source of radiant energy;

radiant energy sensitive means, sensitive to exposure to said radiant energy; fibre optic thread means for forming said radiant energy into a narrow spot adapted for transmitting said radiant energy, with said source of radiant energy at one end, the other end of said fibre optic thread means being adjacent to said radiant energy sensitive means, and said radiant energy sensitive means defining a predetermined area having length and breadth, upon a portion of which said spot of radiant energy may be received, and recorded, while the remainder of said area of said sensitive means remains unaffected thereby, whereby to record the position of said spot of radiant energy on said predetermined area of sensitive material;

support means for said radiant energy sensitive means;

flexible connection means extending between said radiant energy source support means and said support means for said sensitive means, permitting relative angular movement between said spot of radiant energy and said radiant energy sensitive means and, rigid support means surrounding said fibre optic thread means within said flexible connection means.

2. A bore hole probe as claimed in claim 1 wherein said radiant energy is light, and wherein said radiant energy sensitive means comprises a strip of film.

3. A bore hole probe as claimed in claim 1 wherein said rigid support means is of generally elongated conical shape, with the tip of said cone being located adjacent said radiant energy sensitive means.

4. A bore hole probe as claimed in claim 1 wherein said flexible means comprises a generally elongated tubular sleeve member, extending between said support means for said radiant energy source, and said support means for said radiant energy sensitive means, and enclosing the space therebetween.

5. A bore hole probe as claimed in claim 1 wherein said radiant energy sensitive means includes image screen means adapted to receive said narrow spot of radiant energy, and image recording means for recording the image of said spot on said image screen.

6. A bore hole probe as claimed in claim 5 including gravity sensitive means adjacent said image screen means, providing an image vertical reference point, said image recording means recording the image of both said narrow spot and said vertical reference point simultaneously.

7. A bore hole probe as claimed in claim 6 including illumination means for illuminating said vertical reference indicator means.

8. A bore hole probe as claimed in claim 7 wherein said radiant energy is light, and wherein said radiant energy sensitive means includes a length of photographic film, and lens means between said film and said image screen means, whereby the image of said image screen means may be received on said photographic film, and including film transport means for transporting said film relative to said lens means whereby a plurality of said images may be recorded one after the other on a length of said film.

9. A bore hole probe as claimed in claim 7 wherein said vertical reference indicator comprises an annular tube, liquid in the tube incompletely filling the same whereby to define a bubble therein to indicate vertical orientation as aforesaid.

10. A bore hole probe as claimed in claim 9 including an image screen, and wherein said annular tube is located around said image screen to provide a single image comprising said narrow spot, and said bubble.

11. A bore hole probe as claimed in claim 10 including light means for illuminating said annular tube.

12. A bore hole probe as claimed in claim 11 wherein said light means includes a sleeve of translucent light transmitting material, located adjacent said annular tube, and a light source for lighting said sleeve.

* * * * *